US008960324B2

(12) United States Patent
Holliday et al.

(10) Patent No.: US 8,960,324 B2
(45) Date of Patent: Feb. 24, 2015

(54) TOP DRIVE WITH AUTOMATIC ANTI-ROTATION SAFETY CONTROL

(75) Inventors: Keith A. Holliday, Houston, TX (US); Todd Mironuck, Longview (CA); Paul Nicholson, Montgomery, TX (US); Dan Flaherty, Rocky Mt. (CA)

(73) Assignee: GDS International, LLC, Houston, TX (US)

( * ) Notice: Subject to any disclaimer, the term of this patent is extended or adjusted under 35 U.S.C. 154(b) by 576 days.

(21) Appl. No.: 13/359,898

(22) Filed: Jan. 27, 2012

(65) Prior Publication Data

US 2013/0192859 A1 Aug. 1, 2013

(51) Int. Cl.
*B23Q 5/00* (2006.01)

(52) U.S. Cl.
USPC ..... 173/4; 166/250.01; 166/380; 175/220; 175/27; 175/162

(58) Field of Classification Search
CPC ..... E21B 47/00; E21B 43/26; E21B 44/00; E21B 44/02; E21B 19/16; E21B 19/00
USPC ..... 173/4; 175/27, 162; 166/250.01, 380, 166/77.52, 85.1
See application file for complete search history.

(56) References Cited

U.S. PATENT DOCUMENTS

| | | | | |
|---|---|---|---|---|
| 4,489,794 | A * | 12/1984 | Boyadjieff | 175/85 |
| 4,800,968 | A * | 1/1989 | Shaw et al. | 175/85 |
| 7,182,133 | B2 * | 2/2007 | Webre et al. | 166/250.01 |
| 8,567,512 | B2 * | 10/2013 | Odell et al. | 166/379 |
| 2010/0065336 | A1 * | 3/2010 | Wells et al. | 175/220 |
| 2011/0232919 | A1 * | 9/2011 | Snider et al. | 166/380 |
| 2012/0080227 | A1 * | 4/2012 | Cardellini et al. | 175/40 |
| 2012/0152530 | A1 * | 6/2012 | Wiedecke et al. | 166/250.01 |
| 2012/0152619 | A1 * | 6/2012 | Hofste et al. | 175/57 |

FOREIGN PATENT DOCUMENTS

WO WO 2010141287 A2 * 12/2010 ..... E21B 17/00

* cited by examiner

*Primary Examiner* — Thanh Truong
*Assistant Examiner* — Dianne Mitchell
(74) *Attorney, Agent, or Firm* — Richard A. Fagin

(57) ABSTRACT

An automatic drilling system includes a top drive comprising a proximity sensor disposed in a housing thereof. A portion of the top drive is coupled to elevators through load transfer springs such that axial loading applied to the elevators results in relative movement between a link load collar and a load ring. A proximity sensor is mounted such that the relative movement results in a change in signal output thereof. A processor is in signal communication with the proximity sensor and is configured to operate a drive shaft motor. The processor is configured to disable rotation of the motor when the relative movement is indicative of axial loading on the elevators.

3 Claims, 5 Drawing Sheets

TOP DRIVE WITH AUTOMATIC ANTI-ROTATION SAFETY CONTROL

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

FIG. 1 illustrates a top drive system 10 which is structurally supported by a derrick 11. The top drive system 10 has a plurality of components including a top drive 14, (shown schematically) a main drive shaft 16, a motor housing 17, a drill string 19 and a drill bit 20. The components are collectively suspended from a traveling block 12 (moved by a "drawworks"—not shown) that allows them to move upwardly and downwardly on rails 22 connected to the derrick 11 for guiding the vertical motion of the top drive system components. Reactance to torque generated during operations with the top drive and its components (e.g. during drilling) is transmitted through the rails 22 to the derrick 11.

The main drive shaft 16 extends through the motor housing 17 and connects to items below the shaft ("stem" or "shaft" can include stems and shafts). The main drive shaft 16 may be non-threadedly connected to an upper end of an IBOP assembly 24 which is the first in a series of items and/or tubular members collectively referred to as the drill string 19. An opposite end of the drill string 19 is threadedly connected to a drill bit 20.

During operation, a motor 15 (shown schematically) encased within the motor housing 17 rotates the main drive shaft 16 which, in turn, rotates the drill string 19 and the drill bit 20. Rotation of the drill bit 20 produces a wellbore 21. Drilling fluid pumped into the top drive system 10 passes through the main drive shaft 16, the drill string 19, the drill bit 20 and enters the bottom of the wellbore 21. Cuttings removed by the drill bit 20 are cleared from the bottom of the wellbore 21 as the pumped fluid passes out of the wellbore 21 up through an annulus formed by the outer surface of the drill bit 20 and the walls of the wellbore 21. Typical elevators 29 are suspended from the top drive system 10 to perform "pipe tripping" operations as will be explained in more detail.

A variety of items can be connected to and below the main drive shaft 16; for example, and not by way of limitation, the items shown schematically as items 24 and 26 which, in certain aspects, and not by way of limitation, may be an upper internal blowout preventer 24 and a lower internal blowout preventer 26. In other systems according to the present invention the item 24 may be a mud saver apparatus, a load measuring device, a flexible sub, or a saver sub. A connection assembly 40 can non-threadedly connect the item 24 to the main drive shaft 16. The main drive shaft 16 may be a drill stem or a quill.

In typical top drive drilling operations, the top drive elevators 29 are set to have a pipe handler (explained below) orientated in one rotational direction to trip pipe (move the drill string into and out of the wellbore), which limits the travel of the elevators 29. This allows the elevators 29 to clear a racking board and/or parts in relation to the racking board, and this may include parts of the derrick 11. Such orientation allows the top drive 10 to travel up to or down from the racking board 42 and crown (top of the derrick 11) without the possibility of interference between the top drive pipe handling equipment and other items. This also allows the elevators 29 and associated pipe handling equipment to extend out as close as possible to the derrick man/racking board without of interference between components.

When the elevators 29 are used to move the drill string 19 into and out of the well, certain components of the top drive experience metal to metal contact by reason of the axial load of the drill string 19 on the elevators 29. If the top drive motor 15 (shown schematically) rotates the main drive shaft 16 when substantial axial loading is applied to the elevators 29, there is risk of damage to the top drive because of metal to metal contact between a "link load collar" that transfers load on the elevators 29 to the housing 17 and to the main drive shaft 16, and the main drive shaft.

There exists a need for an automatic system to determine whether there is axial loading in the elevators to automatically prevent rotation of the main drive shaft or "quill" during such times as axial loading is applied to the elevators.

SUMMARY

One aspect of the invention is an automatic drilling system including a top drive comprising a proximity sensor disposed in a housing thereof. A portion of the top drive is coupled to elevators through load transfer springs such that axial loading applied to the elevators results in relative movement between a link load collar and a load ring. A proximity sensor is mounted such that the relative movement results in a change in signal output thereof. A processor is in signal communication with the proximity sensor and is configured to operate a drive shaft motor. The processor is configured to disable rotation of the motor when the relative movement is indicative of axial loading on the elevators.

Other aspects and advantages of the invention will be apparent from the description and claims which follow.

DETAILED DESCRIPTION

Figure 1:
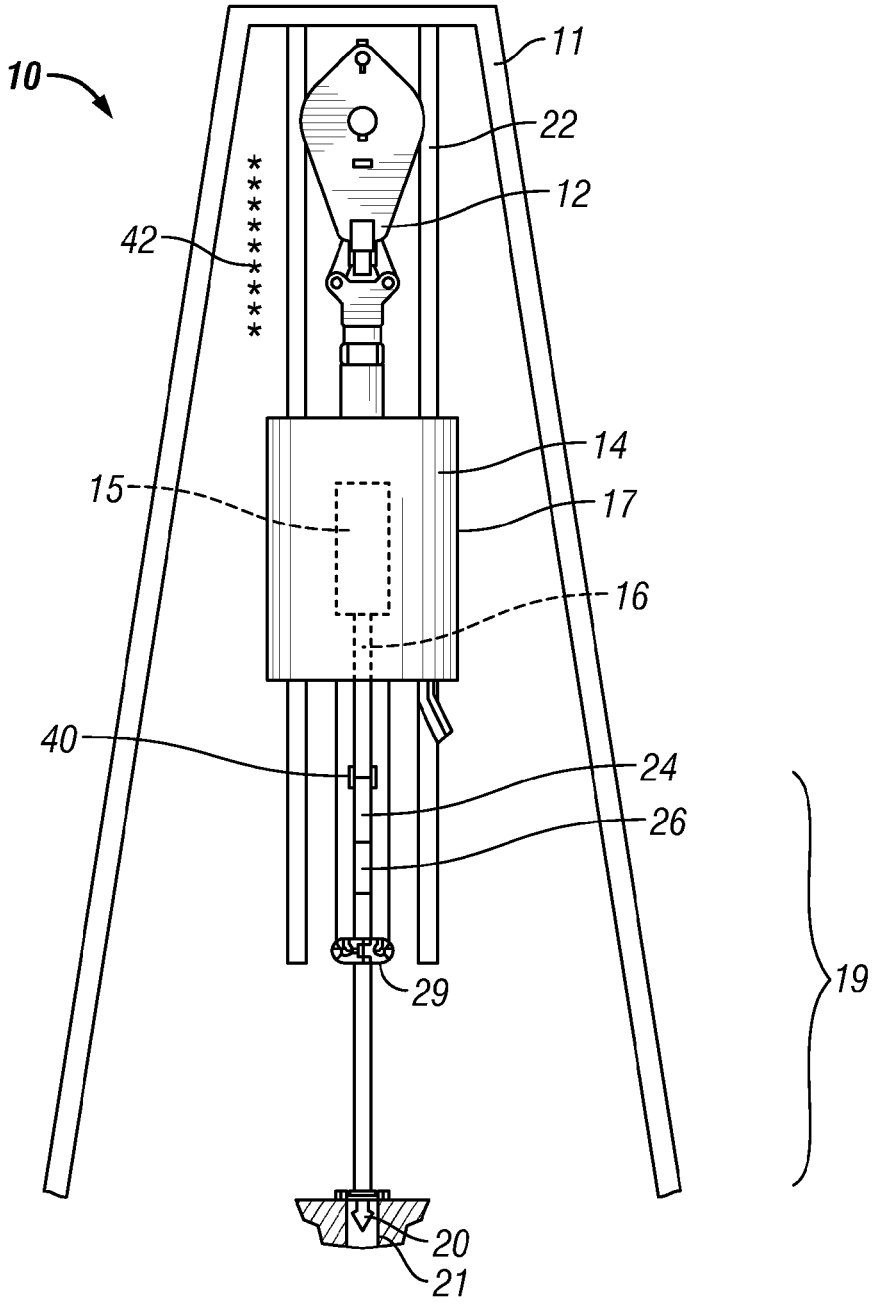
FIG. 1 (Prior Art)
FIG. 1 shows a top drive in a drilling unit derrick.
Figure 2:
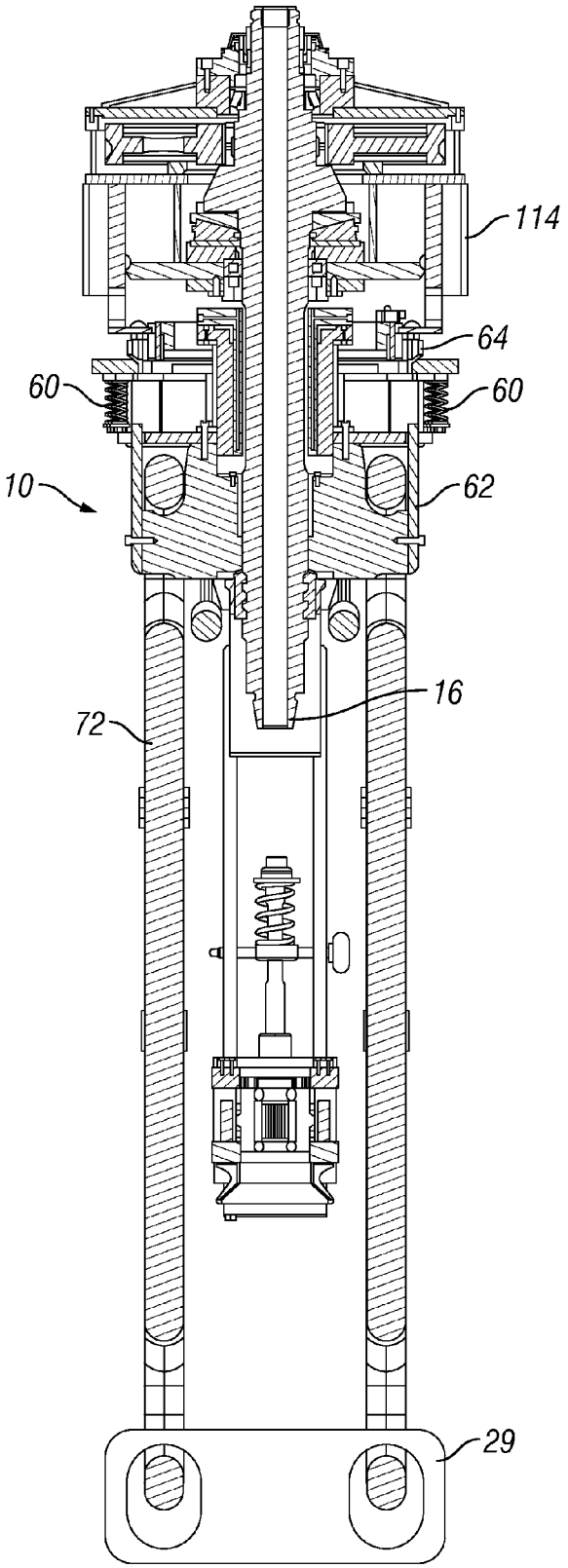
FIG. 2 shows a cut away side view of a top drive.
Figure 3A:
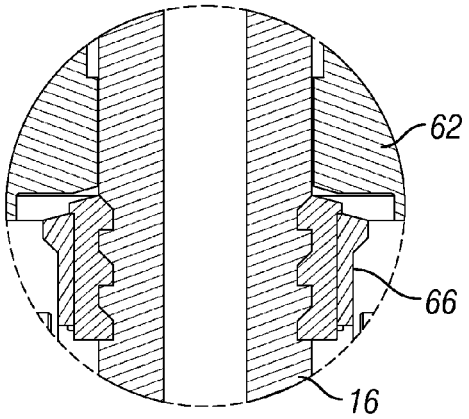
FIG. 3A shows a detail view of a portion of the top drive where a link load collar may contact a load ring connected to the main shaft of the top drive when axial load is applied to the elevators.
Figure 3B:
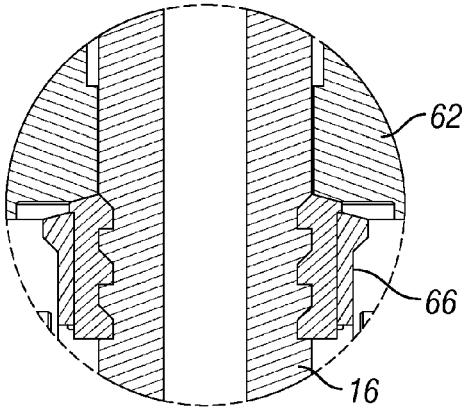
FIG. 3B shows the view of FIG. 3A where axial loading is applied to the elevators.

FIG. 2 shows a cut away view of a top drive system 10 according to the invention. The top system drive 10 is shown in simplified form to illustrate the relevant parts of a system according to the invention. Elevators 29, a pipe handler rotate gear 64, load transfer springs 60 and a link load collar 62 are shown. The foregoing parts of the top drive system 10 are capable of rotating 360 degrees in either direction independently of the other operating parts of the top drive 10 (e.g., the main drive shaft 16). The main drive shaft is shown at 16. A rotary manifold, drive motor (15 in FIG. 1) and top drive housing are shown schematically at 114. A portion of the top drive system 10 shown in expanded detail in FIGS. 3A and 3B is indicated in FIG. 2. The motor (15 in FIG. 1) may be selectively operated to rotate the main drive shaft 16 when it is desired to rotate the drill string (19 in FIG. 1).

FIG. 3A shows the indicated section of FIG. 2 in more detail. The link load collar 62 transfers axial loading applied to the elevators (29 in FIG. 2) through bails 72 during times when the drill string is being lifted out of a wellbore or moved into a wellbore other than for drilling (i.e., "tripping"). As can be observed in FIG. 3A, where there is no axial loading on the elevators (29 in FIG. 2), there is a gap between the link load collar 62 and the load ring 66. In FIG. 3B, axial loading is applied to the elevators and the gap is closed.

Application of axial loading on the elevators (29 in FIG. 2) causes the link load collar 62 to move axially, by compressing the springs (60 in FIG. 2) so that the link load collar 62 comes into contact with a load ring 66. If the main drive shaft 16 were to be rotated when such contact exists as shown in FIG. 3B, both the link load collar 62 and the load ring 66 (attached to the main drive shaft 16) could be damaged or could fail.

Figure 4:
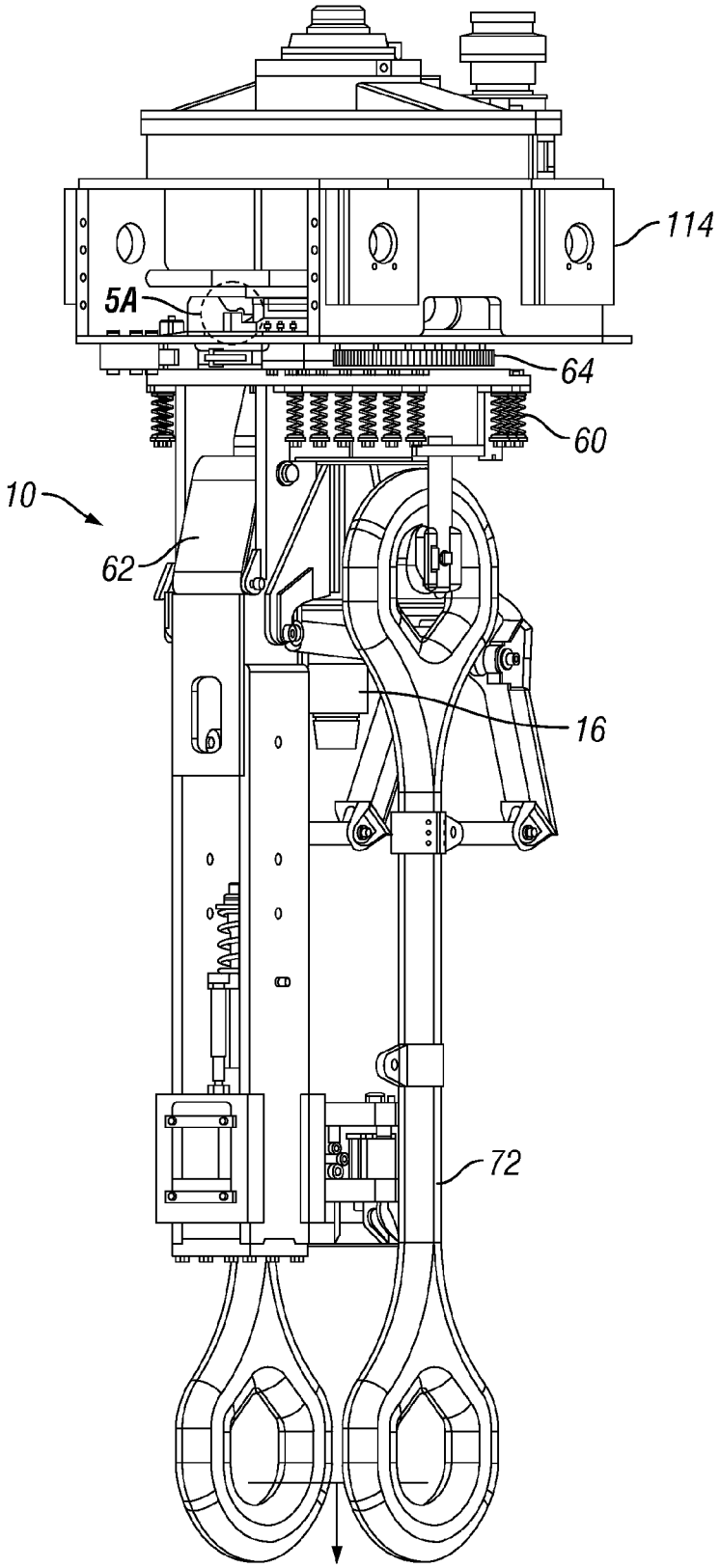
FIG. 4 shows an oblique view of the top drive.

The top drive shown in cut away side view FIG. 2 is shown in oblique view in FIG. 4 to illustrate a specific component of a system according to the invention. A detail indicated at FIG. 5A in FIG. 4 is in the rotary manifold 114 portion of the top drive system 10. When no load is on the elevators the springs 60 keep the link load collar 62 and load ring 66 from making contact with each other When axial loading is applied to the elevators 29, the springs 60 compress and the link load collar 62 drops onto the load ring 66. Axial loading is transferred through the link load collar 62 to the load ring 66. The link load collar 62 is shown proximate the main drive shaft 16.

Figure 5A:
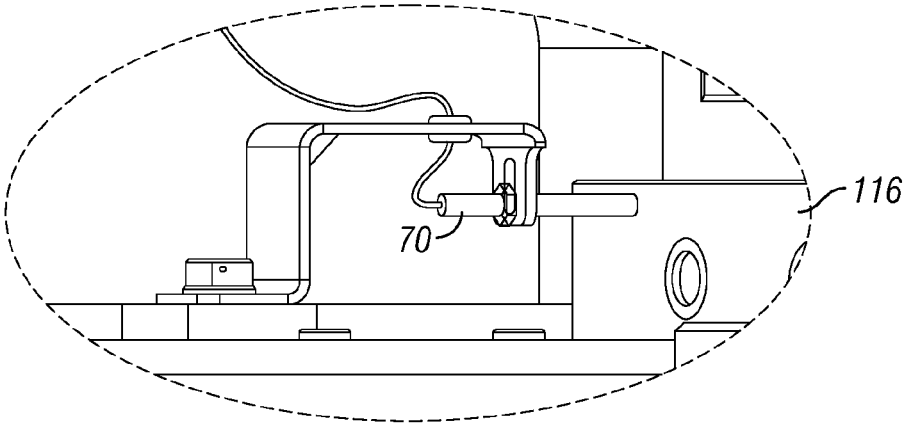
FIGS. 5A, 5B and 5C show a detail of a proximity sensor mounted in the top drive.
Figure 5B:
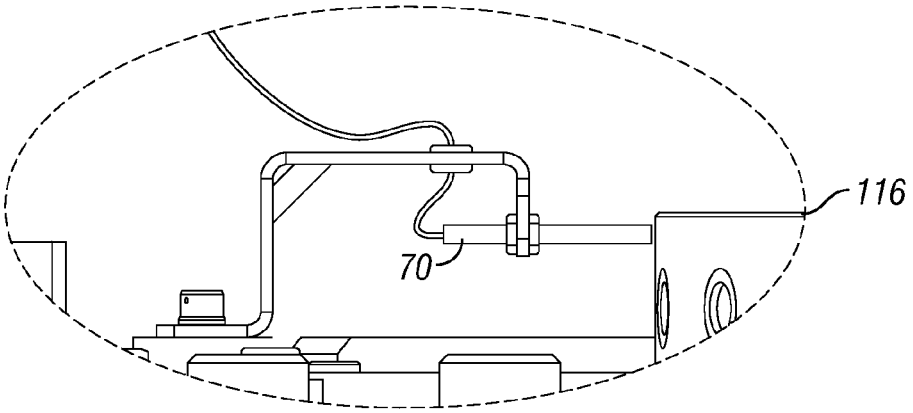
Figure 5C:
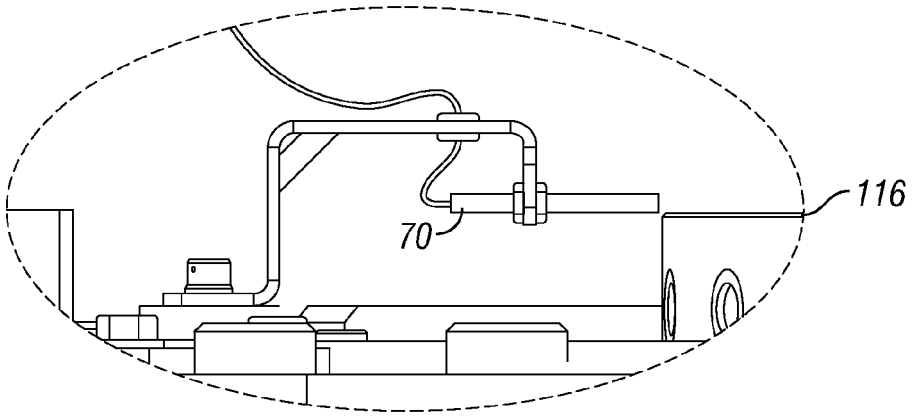

The detail section indicated in FIG. 4 is illustrated in FIG. 5A. A proximity sensor 70, which may be a magnetic sensor, capacitance sensor, optical sensor or any similar device may be mounted in the pipe handling rotator system so that the proximity sensor 70 senses movement of a rotary manifold 116 to the same extent as does the link load collar (62 in FIG. 2) as axial loading is applied and released from the elevators (29 in FIG. 4). When no axial loading is applied to the elevators, the rotary manifold 116 may be disposed proximate the proximity sensor 70. Example dimensions for gaps between the proximity sensor 70 and the portion 116 are shown in FIG. 5B in the condition that no axial loading is applied to the elevators (29 in FIG. 2). In FIG. 5C, the rotary manifold 116 is moved away from the proximity sensor 70 as axial loading is applied to the elevators (29 in FIG. 2). Signals from the proximity sensor 70 may be coupled to a system controller, explained below with reference to FIG. 6, so that rotation of the main drive shaft (16 in FIG. 4) is automatically prevented when signals from the proximity sensor 70 correspond to the condition that axial load is applied to the elevators (29 in FIG. 2).

Figure 6:
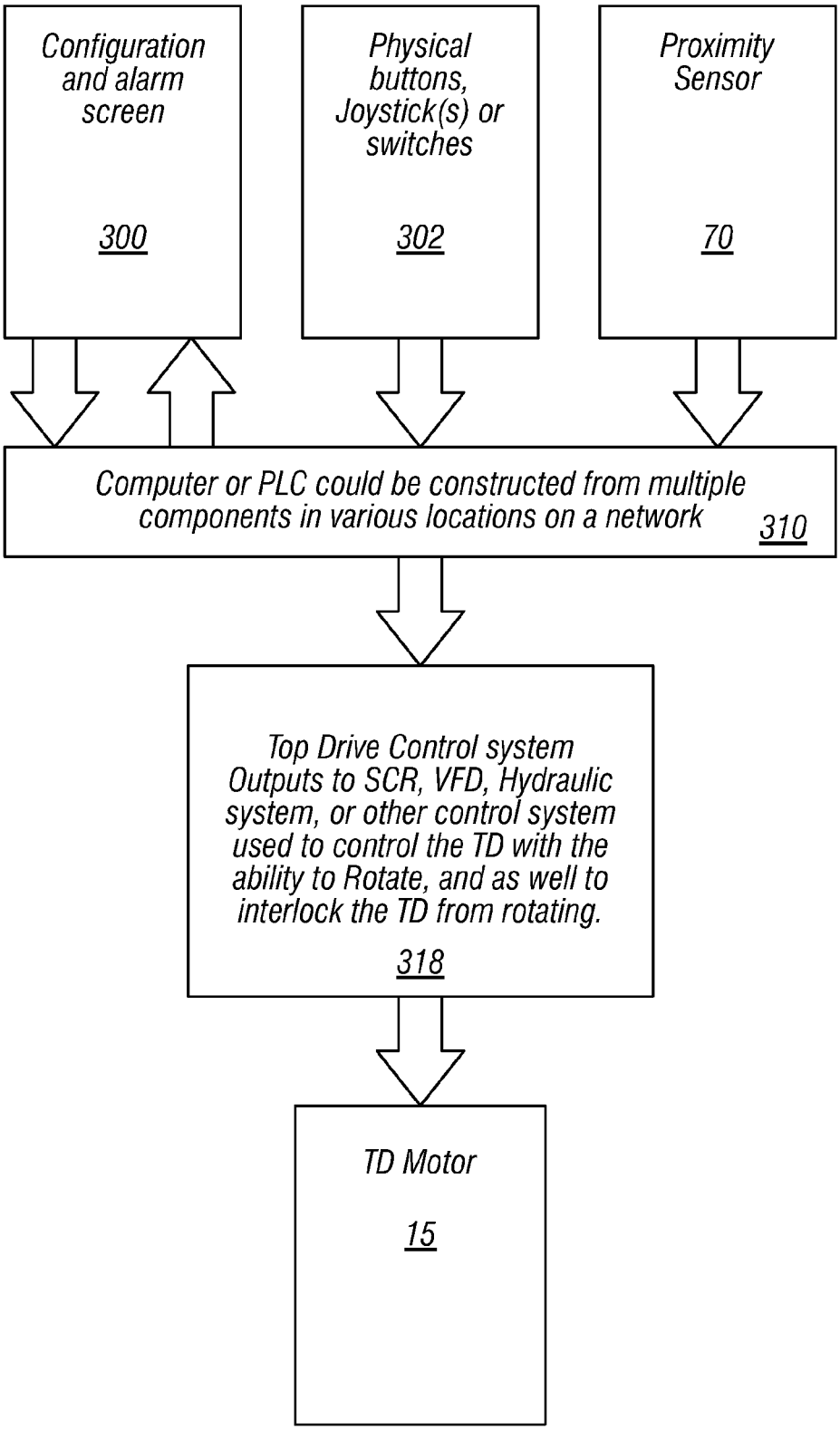
FIG. 6 shows an example control system using signals from the proximity sensor.

An example system control configuration is shown in block diagram form in FIG. 6. An example operator console 300 that may be used with a system according to the invention may be a "touch screen" combination display and input control such as one sold by GE Fanuc Automation Americas, Inc. or similar control panel, although the type of control panel or operator console is not a limitation on the scope of the invention. At 310 a general purpose programmable computer or programmable logic controller (PLC) may provide the operating controls to operate the system. At 300, the operator console may be used as input to control operation of the system. At 302, the system controls may be separate buttons or other physical switches, or may be part of the touch screen if such is used for the operator console 300.

Signal input from the proximity sensor (70 in FIGS. 5A-5C) may also be provided to the PLC 310. In the present example, the PLC 310 may be programmed or otherwise configured to display a visual and/or audible alarm through the operator console 300 and log/store time and date of occurrence and automatically disable operation of the motor (15 in FIG. 1) notwithstanding input from the operator console 300 or controls 302 to cause rotation of the motor (15 in FIG. 1) when signals from the proximity sensor (70 in FIGS. 5A-5C) indicate that axial load is applied to the elevators (29 in FIG. 4). At 318, a VFD, SCR or other motor driver in signal communication with the PLC 310 can supply power to the motor (15 in FIG. 1). As explained above, the PLC may be programmed or configured to inhibit transmission of power to the motor when the proximity sensor 70 indicates load is applied to the elevators (29 in FIG. 1).

A top drive having an automatic device to disable rotation of the drive motor may prevent unintended rotation of the drive shaft when weight is applied to the elevators. Such automatic rotation disablement may prevent damage to the top drive when the link load collar thereof is in contact with the load ring attached to the drive shaft.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A top drive system, comprising:

a top drive comprising a proximity sensor disposed in a housing thereof;

a portion of the top drive coupled to elevators through load transfer springs such that axial loading applied to the elevators results in relative axial movement between a link load collar coupled to the elevators and a load ring coupled to a drive shaft, the proximity sensor mounted to a part of the top drive wherein the relative axial movement between the link load collar and the load ring results in change in distance between the proximity sensor and another part of the top drive such that the relative axial movement between the link load collar and the load ring results in a change in signal output thereof; and a processor configured to operate a drive shaft motor rotationally coupled to the drive shaft, the processor in signal communication with the proximity sensor, the processor configured to disable rotation of the motor when the relative axial movement between the link load collar and the load ring is indicative of axial loading on the elevators.

2. The system of claim 1 wherein the processor is configured to generate an alarm signal and/or to log date and time of the relative movement being indicative of the axial loading when an operator input is selected to cause rotation of the motor.

3. The system of claim 1 wherein the proximity sensor comprises at least one of a magnetic sensor, a capacitance sensor and an optical sensor.

* * * * *